United States Patent [19]

Daun

[11] Patent Number: 4,679,620

[45] Date of Patent: Jul. 14, 1987

[54] METHOD AND APPARATUS FOR CLEANING PLATE HEAT EXCHANGERS USED FOR RECOVERING HEAT FROM EXHAUST GASES

[76] Inventor: Klaus-Dieter Daun, Am Sounenhang 33, D 4300 Essen 17, Fed. Rep. of Germany

[21] Appl. No.: 834,882

[22] Filed: Feb. 28, 1986

[30] Foreign Application Priority Data

Mar. 1, 1985 [DE] Fed. Rep. of Germany ..... 3507203

[51] Int. Cl.[4] ..... F28G 9/00

[52] U.S. Cl. ..... 165/95; 122/390

[58] Field of Search ..... 165/95, 5; 122/390

[56] References Cited

U.S. PATENT DOCUMENTS

| | | | |
|---|---|---|---|
| Re. 16,807 | 12/1927 | Haber | 165/95 |
| 2,477,334 | 7/1949 | Hibner et al. | 165/95 X |
| 2,604,358 | 7/1952 | Richards | 165/95 X |
| 3,184,774 | 5/1965 | Burch | 165/95 X |
| 3,434,532 | 3/1969 | Henriksson | 165/95 X |
| 4,225,362 | 9/1980 | Sentell | 165/95 X |
| 4,333,742 | 6/1982 | Tanca | 122/390 X |

*Primary Examiner*—Albert W. Davis, Jr.
*Assistant Examiner*—Richard R. Cole
*Attorney, Agent, or Firm*—McGlew and Tuttle

[57] ABSTRACT

The invention relates to a method and appartus for cleaning plate heat exchangers of a type used for recovering heat from contaminated exhaust air. Such heat exchangers have heat exchanger plates arranged in a row creating spaces between them, and exhaust air is passed between the heat exchanger plates. The heat exchanger plates are provided with through holes, in alignment to receive a soot blower lance that is mounted in a heat exchanger or housing wall in such a way that it is rotatably and axially movable. The soot blower lance head and the lance can be turned and moved forward.

7 Claims, 2 Drawing Figures

METHOD AND APPARATUS FOR CLEANING PLATE HEAT EXCHANGERS USED FOR RECOVERING HEAT FROM EXHAUST GASES

FIELD AND BACKGROUND OF THE INVENTION

The invention relates in general to cleaning devices and in particular to a new and useful method and apparatus for cleaning plate heat exchangers used for recovering heat from exhaust.

The invention relates particularly to a device for cleaning heat exchangers which are used for recovering heat from contaminated exhaust air, where the heat exchanger plates are arranged in a row inside the heat exchanger housing creating spaces between them and the exhaust air is passed between the heat exchanger plates.

In order to recover heat from, for example, spray-drying units, a known method is to use plate heat exchangers. In such heat exchangers, the heat exchanger plates are mounted vertically parallel to one another at intervals of 10 mm to 12 mm. The exhaust air is passed between the heat exchanger plates from above and gives up its heat to the heat carrying madium, usually water, that circulates inside the heat exchanger plates. The heated circulating water is pumped through a tube to, for example, a laminar tubular heat exchanger and there pre-heats the intake air of the spray drying unit. Since contaminated air is usually used for the heat recovery, regardless of whether it is exhaust air from the spray drying unit or from other industrial units, the plate heat exchanger must be equipped with a cleaning device. The surfaces of the heat exchanger plates are generally cleaned by applying superheated steam, water or other fluids such as compressed air. For this purpose, over the heat exchanger plates, which constitute a battery, a parallelogram-like nozzle frame is suspended, which can be moved into place over the heat exchanger plates and has spray nozzles that project the cleaning agent between the heat exchanger plates in order to spray off deposits of dirt from the exhaust air that adheres to them. The dirt is then collected in a trough under the heat exchanger plates and removed. There are several disadvantages, however, to a cleaning device of this kind. In an inoperative position, for example, the nozzle frame is positioned above the heat exchanger plates or batteries of plates and consequently is constantly exposed to the contaminated exhaust air, thus gets dirty itself and has to be cleaned in turn. Furthermore, the parallelogram-like suspension of the nozzle frame is also exposed, and its swing bearings require frequent maintenance because of the unavoidable fouling.

The invention provides a device for cleaning plate heat exchangers for recovering heat from contaminated air provides an improved cleaning method with increased security of operation and optimum cleaning efficiency and which may be carried out exceptionally well even when the heat exchanger plates are subject to extremely contaminated exhaust air. In addition, maintenance and cleaning of the device itself is reduced to a minimum.

The invention includes a cleaning device which is capable of cleaning the heat exchanger plates which have aligned through holes which receive a soot blower mounted in the wall of the housing of the plate heat exchanger. The device includes a soot blower lance which has, at least in the area of the lance head, two blower nozzles placed diametrically opposite one another. The lance is mounted so that it can be turned and moved forward. In the context of the invention, the housing wall may also be one of the two outer heat exchanger plates of a plate heat exchanger.

Soot blowers are known in the art, but are generally used to solve fouling problems encountered in the operation of boilers and industrial furnaces. The problems encountered with cleaning plate heat exchangers for recovering heat from contaminated exhaust air have in the past been neither solved nor influenced by such soot blowers. The invention is based, however, on the perception that such soot blower is also appropriate for cleaning heat exchanger plates of a plate heat exchanger that is exposed to extremely contaminated exhaust air for the sake of recovering the heat from it and to which the deposit of dirt particles that builds up on the surfaces of the heat exchanger plate therefore adheres particularly firmly. Surprisingly, the use of a soot blower in the inventive way entails only minimal losses of pressure over the height and breadth of the heat exchanger plates, even though the interval between the heat exchanger plates is usually no more than 10 mm to 12 mm. Yet perfect removal of the dirt deposit is accomplished, even near the edges of the heat exchanger plates. This may be attributable to the relatively small interval between the heat exchanger plates and the minimal drop in pressure in the cleaning agent that comes out of the blower nozzles. This cleaning agent may be the usual choice of superheated steam, water, compressed air or special cleaning fluids. It is also possible to do the cleaning with abrasives or other finely powdered solids. The cleaning may also be done according to a pre-programmed model, whereby the cleaning agents that come out of the nozzles can be of the same or of different kinds. They may be different, for instance, in order to start by moistening the contaminants and continue by softening, rinsing or blasting. Since the soot blower lance is mounted so that it can turn and be moved forward, it can be controlled in the course of the cleaning process so that the rotating blower nozzles are moved forward and back through the heat exchanger plates to be cleaned at least once, but preferably several times, so that the heat exchanger plates are subjected in the space areas repeatedly on both sides of the cleaning agent. By this means, the heat exchanger plates can be cleaned perfectly even if they are exposed to exhaust air from power plants for purposes of heat recovery.

Other features essential to the invention are explained below. The invention teaches, for instance, that the through holes are larger in diameter than the soot blower lance and that the soot blower lance is suspended on its mounting and can be moved forward through the heat exchanger plates without resting on them. In this way, the turning or rotating movement of the soot blower lance is not hampered. In a preferred embodiment of the invention, the through holes are placed in the center of the heat exchanger plates and the soot blower is mounted at the midpoint of the housing wall. Surprisingly, perfect cleaning of the heat exchanger plates is accomplished even in the far corner areas. Moreoever, in principle, it is possible to place several soot blowers side by side and/or one above the other. In addition, the soot blower lances may each have several blower nozzles distributed over their length and circumference.

In another preferred embodiment of the invention, the soot blowers are used with a plate heat exchanger where the heat exchanger plates are designed as thermal sheets. Such thermal sheets consist of two or three sheets of stainless steel welded together at precisely defined points. The sheets are expanded after welding so that a cushion-shaped intermediate space is created between the welded sheets and weld points. In this intermediate space the water to be heated, for example, or another heat carrying medium is circulated. It is important in this connection that the through holes for the soot blower lance pursuant to the invention be perfectly sealed against the escape of the heat carrying medium. An an example, the sheets may be welded together around the perimeter of the through holes so that in this area another spot weld is created that does not hamper the circulation of the heat carrying medium.

The primary advantage of the invention is that a device for cleaning plate heat exchangers for recovering the heat from contaminated exhaust air is realized that because of its improved method of operation and optimum efficiency is excellent precisely for plate heat exchangers where the heat exchanger plates are designed as thermal sheets. In any case, the soot blowers and the soot blower lance that penetrate the heat exchanger plates insure perfect cleaning of the plate surfaces and dissolve quickly even the dirt particles from the exhaust air that adhere to the corner areas. Since the soot blower lance can be virtually retracted out of the plate heat exchanger once the cleaning process is completed, it is not exposed to contaminated exhaust air itself and thus requires no cleaning of its own and is relatively maintenance-free. Overall, the cleaning device pursuant to the invention is remarkable for intensive cleaning effectiveness and trouble free operation.

Accordingly, it is an object of the invention to provide an improved method for cleaning a heat exchanger which is used for recovering heat from contaminated exhaust gases which has a plurality of hollow heat exchanger plates arranged in spaced parallel locations to which a heat exchange medium is directed and which comprises providing aligned holes in the heat exchange plates and mounting a soot blower lance on the heat exchanger so that it may be rotated and moved axially through the aligned holes and thereafter directing the cleaning medium through the lance and discharging it radially against the plates as the lance is manipulated to cover the plates with the cleaning fluid discharge as the lance is moved along and rotated relative to the holes in the heat exchanger plates.

A further object of the invention is to provide an improved device for cleaning a heat exchanger which has a plurality of spaced hollow plates through which a heat exchanger medium is directed and which comprises a plurality of holes formed in said plates in aligned relationship, a lance member mounted on the heat exchanger so that it may be rotated and moved axially to direct the lance through the holes.

A further object of the invention is to provide a device for cleaning heat exchangers which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
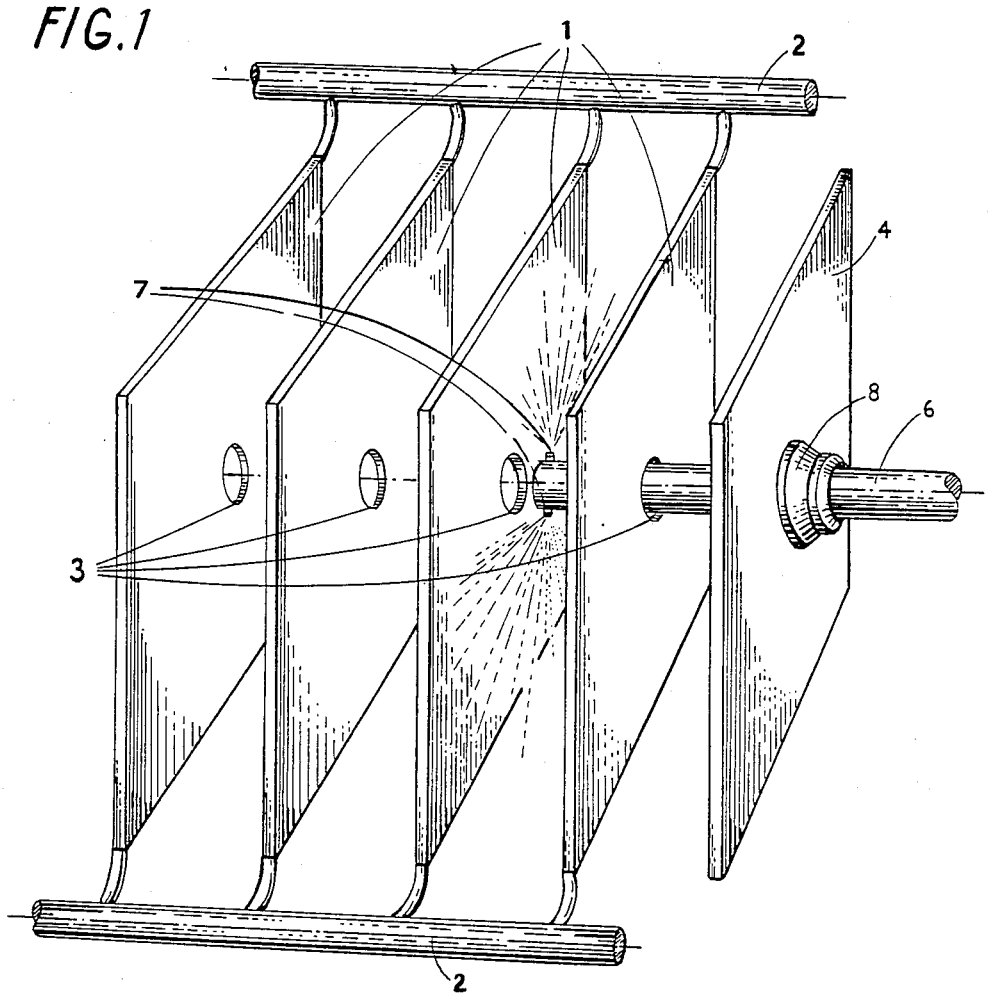
FIG. 1 is a top front perspective view of a cleaning device used with a plate heat exchanger in accordance with the invention.
Figure 2:
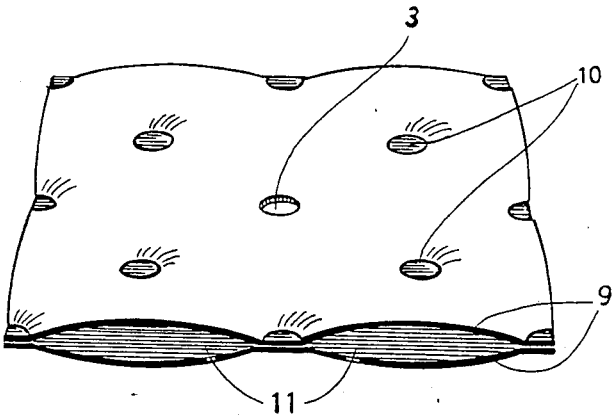
FIG. 2 is a schematic sectional and perspective view of a detail showing a heat exchanger plate designed as a thermal sheet.

Referring to the drawings in particular, the invention embodied therein comprises an apparatus for cleaning the heat exchanger which is used for recovering heat from contaminated exhaust gases which flow between a plurality of spaced parallel plates 1. The heat exchanger includes inlet and exhaust ducts 2, 2 which supply fluid for passage through hollow interiors of the plates 1.

In accordance with the invention, a method of cleaning the heat exchanger comprises mounting a soot blower generally designated 5 so that a lance 6 thereof may be rotated and moved axially through holes 3 which are formed in alignment in the heat exchanger plates 1. In accordance with the invention, the cleaning fluid is directed through the hollow lance 6 as it is rotated on a rotatable bearing 8 secured to a heat exchanger wall 4. The lance is rotated selectively and moved axially selectively so as to discharge the cleaning medium radially through discharge nozzles 7 which are arranged at angularly spaced relationships so that the plates may be cleaned by the cleaning medium as the lance is manipulated.

The figures show a device for cleaning plate heat exchangers for recovering heat from contaminated exhaust air where such plate heat exchangers have heat exchanger plates 1 placed in a rwo creating spaces between them, and exhaust air is passed between these heat exchanger plates. Inside the heat exchanger plates 1 circulates a heat carrying medium, which is fed into the hollow heat exchanger plates 1 and is drawn off after being heated through inlet and outlet pipes 2 that are schematically included in the drawing. The heat exchanger plates 1 have through holes 3 in alignment to receive a soot blower lance 6 mounted in a heat exchanger housing wall 4.

In accordance with the invention, the soot blower lance 6 has at least two blower nozzles 7 placed diametrically opposite one another in the area of the lance head and is, furthermore, mounted in such a way that it can be turned and moved forward. For that purpose a stuffing box bearing 8 is provided in the wall 4. The drive for turning and moving the lance forward may be provided by an electric motor with gears, shaft and time switch, so that the cleaning of the heat exchanger plates 1 can take place automatically at pre-set intervals. The drive mechanism is not shown.

The through holes 3 are larger in diameter than the soot blower lance 6. The soot blower lance 6 is mounted so that it is suspended and can be moved forward through the heat exchanger plates 1 without resting on them. In this way the rotational movement is not hampered. Furthermore, the through holes 3 are positioned in the center of the heat exchanger plates 1. The soot blower 6 is correspondingly mounted in the mid-point of the housing wall. The heat exchanger plates 1 are preferably designed as thermal sheets made of two or three sheets. Shown is one embodiment of two sheets 9 that are welded together at precisely determined points 10 and then expanded so that cushion-shaped intermediate spaces 11 are formed between the welded sheets 9 to allow for circulation of the heat carrying medium. The through holes 3 for the soot blower lance 6 can be integrated into a weld point 10. The two sheets 9 are welded together around the perimeter of the through holes 3, so that escape of the heat carrying medium from the area of the through holes 3 is prevented and yet the circulation of the heat carrying medium is not hindered. The medium may be superheated steam, water or another fluid, but may also be compressed air. Underneath the heat exchanger plates 1 the dirt cleaned off them is collected and removed.

The cleaning agent may as usual be superheated steam, water, compressed air or special cleaning fluids. Cleaning may also be done with abrasives or other finely-powdered solids. Cleaning may also be done according to a preprogrammed model, where the agents that come out of the nozzles may be of the same or different kinds. They may be different, for instance, in order to start by moistening the contaminants and continue by softening, rinsing or blasting. Since the soot blower lance is mounted so that it can turn and be moved forward, it can be controlled in the course of the cleaning process so that the rotating blower nozzles are moved forward and back through the heat exchanger plates to be cleaned at least once, but preferably several times, so that the heat exchanger plates in the gap areas are repeatedly subjected on both sides to the cleaning agent. By this means, the heat exchanger plates can be cleaned perfectly even when they are exposed to exhaust air from power plants for purposes of heat recovery. Since the exhaust air from power plants tends to form sulfuric acid when the cleaning agent is water, in such case it is preferable to use compressed air as the agent. Compressed air cleaning is always recommended in any situation when the exhaust air contains compounds that form acids in combination with water.

While a specific embodiment of the invention has been shown and described in detail to illustrate the application of the principles of the invention, it will be understood that the invention may be embodied otherwise without departing from such principles.

What is claimed is:

1. A method of cleaning a heat exchanger used for recovering heat from contaminated exhaust gases and which has plurality of spaced parallel hollow heat exchanger plates through and between which a heat exchange medium is directed, comprising providing aligned holes through the heat exchanger plates, mounting a soot blower lance on the heat exchanger so that it may be rotated and moved axially through the aligned holes, and directing a cleaning medium through the lance and discharging it radially against the plates as the lance is manipulated to cover the plates with a cleaning discharge as the lance is moved along and rotated relative to the plates and the holes therein.

2. A device for cleaning plate heat exchangers of a type used for recovering heat from contaminated exhaust gases and comprising hollow heat exchanger plates arranged in spaced parallel relationship through which a heat exchange medium is directed in an arrangement in which the exhaust gases are passed through the spaces between the plates, a plurality of through holes defined in each of said plates in aligned relationships, a soot blower mounting on said heat exchanger, a lance carried by said mounting and being rotatable and axially movable relative thereto in alignment with the holes of the plates, said lance being hollowed for carrying a cleaning medium having at least one radially discharging nozzle for discharging the cleaning fluid therefrom adjacent an end thereof, said lance being rotatable and axially movable for discharging the fluid over each of the plates.

3. A device according to claim 2, wherein the holes of said plates are larger in diameter than said soot blower lance, said mounting means providing a suspension for said lance independently of said plates permitting movement of said lance through the openings of said plates without resting thereon.

4. A device according to claim 2, wherein said holes are positioned in the center of said heat exchanger plates, said mounting means located centrally of said plates.

5. A device according to claim 2, including a plurality of mounting means and soot blower lances mounted on said plates in a row.

6. A device according to claim 5, wherein said soot blower lance has a plurality of blower nozzles directed at selected angular radial locations around its periphery.

7. A device according to claim 5, wherein said heat exchanger plates are made up of a plurality of thermal sheets.

* * * * *